US005554070A

United States Patent [19]

Takatoshi et al.

[11] Patent Number: 5,554,070

[45] Date of Patent: Sep. 10, 1996

[54] COIN GAME MACHINE ISLAND AND COIN TREATING APPARATUS

[75] Inventors: Takemoto Takatoshi; Kawashima Kazunari, both of Tokyo, Japan

[73] Assignee: Kabushiki Kaisha Ace Denken, Tokyo, Japan

[21] Appl. No.: 397,164

[22] PCT Filed: Aug. 26, 1993

[86] PCT No.: PCT/JP93/01208

§ 371 Date: Apr. 28, 1995

§ 102(e) Date: Apr. 28, 1995

[87] PCT Pub. No.: WO94/05385

PCT Pub. Date: Mar. 17, 1994

[30] Foreign Application Priority Data

Sep. 7, 1992 [JP] Japan ..... 4-238656
Sep. 7, 1992 [JP] Japan ..... 4-238657

[51] Int. Cl.[6] ..... B08B 3/02; G07D 9/00

[52] U.S. Cl. ..... 453/31; 134/72; 134/131; 453/56; 453/63

[58] Field of Search ..... 453/17, 18, 55, 453/56, 57, 63, 31; 134/72, 73, 131

[56] References Cited

U.S. PATENT DOCUMENTS 2,698,627 1/1955 Kearney et al. ..... 134/72 X
4,342,384 8/1982 Fukase et al. ..... 273/138 R
5,357,648 10/1994 Noestheden ..... 134/72 X

FOREIGN PATENT DOCUMENTS 2-146693 6/1990 Japan .
3-39184 2/1991 Japan .
3-21385 3/1991 Japan .
3-149066 6/1991 Japan .
3-176096 7/1991 Japan .
3-262092 11/1991 Japan ..... 453/57
3-289409 12/1991 Japan .
4-195491 7/1992 Japan .
4-316189 11/1992 Japan .

*Primary Examiner*—F. J. Bartuska
*Attorney, Agent, or Firm*—Armstrong, Westerman, Hattori, McLeland & Naughton

[57] ABSTRACT

A coin game machine island and a coin treating device for use with the coin game machine island is provided, wherein coins as game media can be washed inside the island so that no coin washing equipment needs to be provided outside the island, thereby making it possible not only to restrict the increase in space but also reduce the costs. A coin circulating path is constituted by a distribution conveyer extending at the upper portion of the island, overflow passageways extending downwardly from the outlet end of the distribution conveyer and respective coin game machines, a recovering conveyer extending at the lower portion of the island for connecting the respective overflow passageways, a coin tank placed at the outlet end of the recovering conveyer and a lifter device lifting coins inside the tank to the inlet end of the distribution conveyer. A coin treating device is provided along the length of the coin circulating path. A coin supply machine feeds out coins received therein at a certain pitch, and coins being conveyed to processes downstream the coin supply machine via a conveyer mechanism. Dirty matter on coins being carried over the conveyer mechanism are washed off with water by a coin washing machine, afterwards water on washed coins is removed by using a dehydrator, and finally moisture on dehydrated coins is removed using a dryer.

14 Claims, 8 Drawing Sheets

COIN GAME MACHINE ISLAND AND COIN TREATING APPARATUS

FIELD OF THE INVENTION

This invention relates to a coin game machine island in which plural coin game machines using a coin as a medium and plural coin dispenser dispensing coins corresponding to an amount of inserted money are placed alternately side by side. Also the present invention relates to a coin treating apparatus mounted inside the coin game machine.

BACKGROUND OF THE INVENTION

In the prior art, a coin treating apparatus for washing a coin as a medium has been mounted outside of a coin game machine island. Accordingly, coins, overflowed from both slot machines in the coin game machine island and a supply conveyer located on an upper portion of the island, are first sent to a collecting conveyer under the island (for example under ground). Then coins are sent to a polishing chamber mounted outside of the coin game machine island by the collecting conveyer. After that, coins are washed before being stored in a tank. Those coins in the tank, if necessory, are supplied to the supply conveyer located on the upper portion of each island for returning coins to the islands.

A coin treating apparatus mounted inside the polishing chamber lifts coins and granulated abrasives into a pipe and stirs them. Then abrasives and polished coins are screened at the top end of the pipe to use the abrasives repeatedly. The abrasives are synthetic resin granules. If the abrasives are stirred with the coins, the abrasives contact the coins and absorb dirt from the coins.

The prior coin treating apparatus like above-mentioned has some problems. One problem is that the coin treating apparatus needs a chamber for mounting the coin treating apparatus therein, a tank for storing coins and a large scale conveyer to send coins in the tank to the supply conveyer located on the upper portion of each island. Another problem is that the installation of the coin treating apparatus requires a lot of space and is expensive. Another problem is that the maintenance expences are high.

Furthermore, since the coin surface is so rough, large size abrasives cannot clean dirt off the coin. If small size abrasives are used, all the nooks and cranies of the coin are cleaned; however, the treating of the granular abrasives after polishing coins is difficult and unpractical.

Furthermore, abrasives must be washed regularly because abrasives absorb dirt from coins in polishing them; the washing process requires much time so it is inconvenient. In this case, one method is washing coins by a jet water stream without recycling abrasives. In the method, however, treatment of water after washing is difficult. One example of the method for treating water after washing is evaporating water by sending hot air, however, strong electricity and evaporated water have a bad influence upon the apparatus; furthermore, a solution such as dirt in water is left on the coin surface causing spots and a loss of glossiness on the coin surfaces.

It is an object of the present invention to provide a coin game machine island and a coin treating apparatus which is capable of being mounted inside the coin game island to wash is capable of being inside the island; so the coin treating apparatus does not need as large of a space as was needed by the prior art. Furthermore, the present invention provides lower installation and maintenance costs than the prior art. It is another object of the present invention to provide a coin game machine island and a coin treating apparatus which is capable of sufficiently washing all the nooks and cranies of the coin by water and then eliminating the water on the coins surface efficiently and certainly.

SUMMARY OF THE INVENTION

The present invention is intended to achieve above-mentioned objects and its essential points are disclosed as follows:

In a coin game machine island, plural coin game machines which use a coin as a game medium and plural coin dispensers for dispensing coins corresponding to an amount of money inserted are placed alternatively side by side to form a coin circulating path. The coin circulating pather includes a distribution conveyer extending at each upper portion of the plural coin game machines and the plural coin dispensers; plural overflow passages extending downwardly from the end of the distribution conveyer and respective coin game machines; a collecting conveyer extending at the lower portion of said island and connected to the ends of said respective overflow passages; a coin tank placed at the outlet end side of said collecting conveyer; a lift for lifting coins stored in the coin tank to the inlet end of the distribution conveyer; and a coin washing machine provided in the coin circulating path.

The coin washing machine includes a shower head for sprinkling water over the coins, a rotating brush (72) for polishing wet coins by contacting them with the rotating brush, and a jet nozzle (73) for washing away dirt from the polished coins by shooting a jet stream of water at the coins.

The coin game machine island further includes a coin supply machine for receiving coins on the coin circulating path and sending the coins to the coin washing machine (70) at a given interval; a conveying mechanism for sending coins in the coin supply machine down stream for further processing, a dehydration mechanism for absorbing water on washed coins, and a dryer for removing dampness from the dehydrated coins.

The coin game machine island has plural distribution outlets for each coin game machine which are bored in the side of the distribution conveyer such that each distribution outlet and each coin game machine are connected by a coin introducing passage. A shutter is movable between a shutting position, the distribution conveyer from passing and for introducing coins into the distribution outlet and an opening position for permitting the passing of coins on the distribution conveyer down stream. The shutter is mounted above the distribution conveyer beside each distribution outlet.

A coin treating apparatus is mounted inside a coin game machine island in which plural coin game machines, each of which use a coin as a game medium are placed. The coin treating apparatus includes a coin supply machine for receiving and sending coins at a given interval;

a conveying mechanism for sending coins in the coin supply machine to down stream for further processing;

a coin washing machine for removing dirt on the coins on said the conveying mechanism; and a dehydration mechanism for absorbing water on the washed coins.

The coin supply machine has a storage container (52) for receiving coins. The bottom (54) of container is funnel-shape, coin outlet is bored at the top of the funnel-shaped bottom. A stirring member having a rotating hollow portion for dropping coins to the outside of the coin outlet without taking in coins serially is positioned at the lower portion in the storage container. The storage container is equipped with multistage tilted boards on the inner wall for lightening the weight of the coins on the stirring member between the top opening portion of the storage container and the stirring member at the lower portion of the storage container.

The conveying mechanism of the coin treating apparatus has a first conveying belt reaching to the coin washing machine to convey coins from the coin supply machine without turning coins over. The conveying mechanism also has a second conveying belt. The second conveying belt (63) contacts the first conveying belt and conveys each turned over coin which has one surface washed to the coin washing machine again for washing the unwashed surface. The dehydration mechanism has a pair of guide rollers and an absorbing belt set between the guide rollers. One of the guide rollers is positioned so as to press the absorbing belt on the wet surfaces of the coins on each conveying belt of the conveying mechanism. A dehydration roller is mounted near the other guide roller for squeezing water out of the absorbing belt by putting the absorbing belt between the dehydration roller and the guide roller. A water tank for storing water squeezed out of the absorbing belt is positioned under said dehydration roller.

The coin treating apparatus further includes a dryer which has a heater and a blower.

The coin treating apparatus further includes a coin packer for packing washed and dried coins for every given number of coins.

Accordingly, coins (including medals), as the game medium, are supplied by the distribution conveyer to the plural coin game machines and coin dispensers which one placed alternatingly side by side each other. The distribution conveyer extends at each upper portion of the coin game machines and coin dispensers. Coins used in each coin game machine are sent to the collecting conveyer extending at the lower portion of the island via overflow passages and then the coins are stored in the coin tank which is placed at the outlet end side of the collecting conveyer.

The coins stored in the coin tank are lifted to the inlet end of the distribution conveyer by said lift. Since the coin treating apparatus is provided in the coin circulating path, coin washing can be done in the coin game island. Therefore, the coin washing equipment outside the island and the conveying equipment, such as a large scale conveyer for connecting the island and the coin washing equipment, are unnecessary. Circulating coins which are supplied or collected in the coin game island are treated by the coin treating apparatus as follows.

First the coin supply machine sends out at a given interval coins which have been reduced the conveying mechanism sends coins in the coin supply machine downstream for further processing. Next the washing machine uses water to wash dirt away from coins conveyed on the with conveying mechanism. Second the dehydration mechanism absorbs water from the washed coins. If the island is equipped with a dryer, the dryer removes any remaining dampness from the dehydrated coins. According to the present invention, the washing and treating of coins by the coin treating apparatus will now be explained in detail.

Coins are stored in the storage container. Since the storage container is equipped with multistage tilted boards therein, coins do not fall towards the bottom of the storage containers but slip down the multistage tilted boards. Therefore, the stirring member, located at a lower portion of the storage container never adds excessive weight.

Although the coins which reach the funnel-shaped bottom of the storage container tend to collect at the coin outlet which is bored at the top of the funnel-shaped bottom (54), the coins do not enter the coin outlet easily even when the stirring member is rotated to pick up the coins. In this case, coins enter gradually into the hollow portion through outer gaps of the rotating stirring member and move down to the coin outlet by degrees, and then they are sent to the conveying mechanism at a given interval.

Coins sent to the first conveying belt of the conveying mechanism at a given interval reach the coin washing machine without being turned over. In the coin washing machine, the shower head (71) sprinkles water, either hot or cold, over the coins to wet them water enters into all the nooks and cranies of the coins. Thus, dirt on the coins is dissolved in the water.

Then, the rotating brush polishes the wet coins by contacting them. Finally, the jet nozzle washes away dirt from the polished coins by shooting a jet stream of water at the coins. At this time, the jet stream of water takes off dirt still sticking to the nooks and cranies of the coins. Each coin thus has one surface which has been washed and the coin is then turned over while being conveyed on the second conveying belt of the conveying mechanism and returned to the coin washing machine for washing the other surface.

The coin, on the conveying belt, having both surfaces washed by the coin washing machine is sandwiched between the conveying belt and the absorbing belt of said dehydration mechanism. Therefore almost all of the remaining water on the coin surfaces is absorbed by the absorbing belt. The absorbing belt is sandwiched tightly between one of the guide rollers and the dehydration roller by the side of the guide roller. Water squeezed out of the absorbing belt is recovered and stored in the water tank.

Since almost all remaining water on the coins surfaces is absorbed by the dehydration mechanism dampness on the dehydrated coins is completely removed by blowing hot winds at the coins by a dryer. Thus, the water remaining on the washed coin is treated by the dehydration mechanism and the dryer (90) and is completely removed. Therefore, a solution causing spots and a loss of gloss on the coins' surfaces, such as dirt in water, is not left on the coins surfaces.

The coins that have been subjected to washing treatment by the coin treating apparatus as mentioned above are recirculated inside the island. If the coin treating apparatus is equipped with a coin packer for packing a given number of washed and dried coins in a paper or plastic case, the coins are packed and can also be recirculated in the island together with nonpacked coins as need.

In a simple construction where the distribution outlets are bored in the side of the distribution conveyer in the coin circulating path, each distribution outlet and each coin game machine are connected by a coin introducing passage, and the shutter, which can move between the closed position and the open position, is mounted above the distribution conveyer beside each distribution outlet so that, each coin game machine is supplied with suitable number of coins efficiently as needed. When the shutter is in the open position, coins on the distribution conveyer are conveyed downstream. When the shutter is in the closed position, coins on the distribution conveyer are prevented from passing. The coins are then introduced into the distribution outlet for distribution of coins to the game machines (11) that need coin coins supplied.

DETAILED DESCRIPTION OF THE INVENTION

The accompanying drawings, show the preffered embodiments of the present invention.

FIGS. 1~FIG. 13 show the second embodiment.

Figure 1:
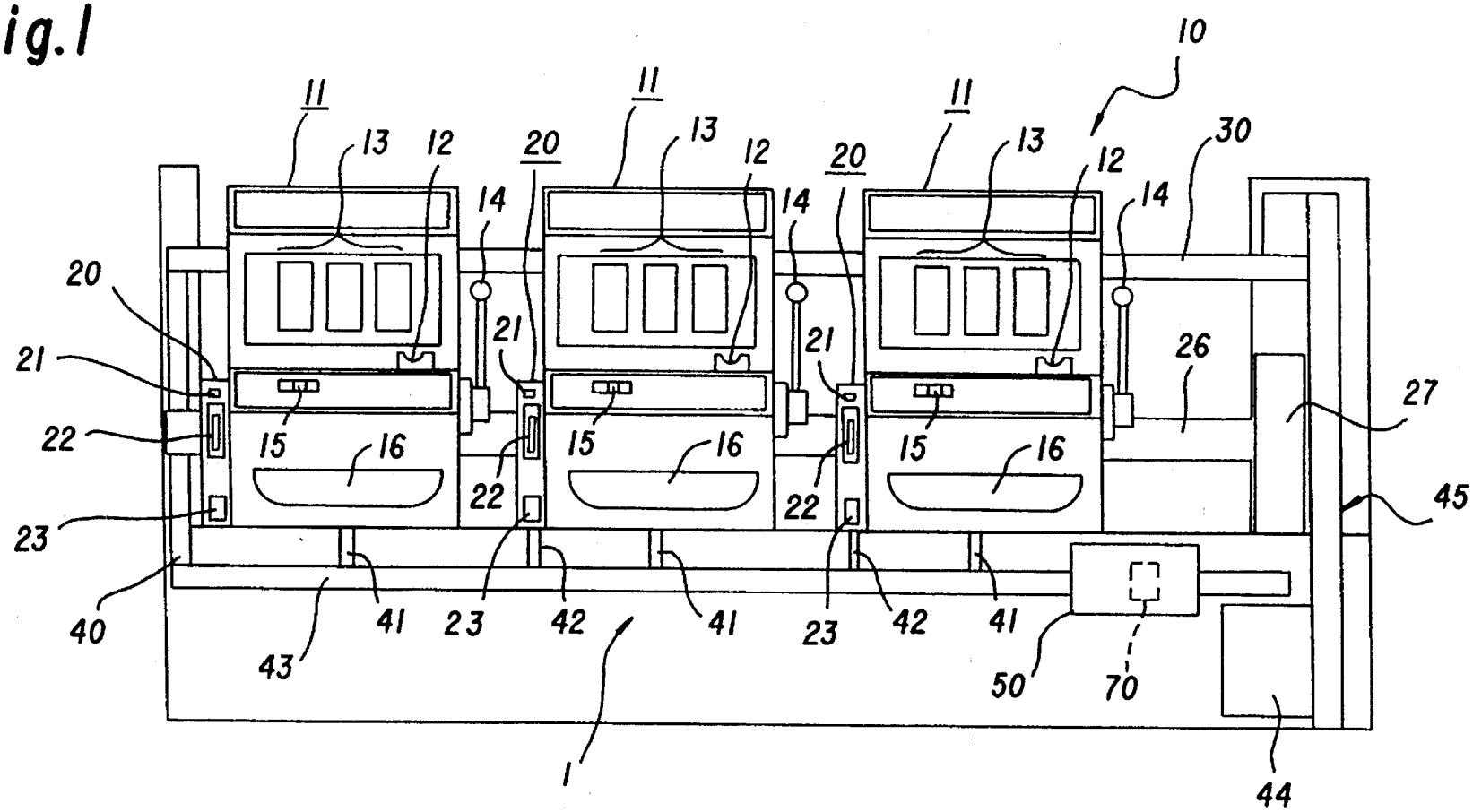
FIG. 1 is an elevational view showing the first embodiment of a coin game island.

As shown in FIG. 1, a coin game island 10 of the present invention includes plural coin game machines 11 each of which uses a coin as a game medium and plural coin dispensers 20 dispensing coins corresponding to an amount of money inserted. The coin game machines are placed beside the plural coin dispensers. A coin circulating path 1, for supplying coins to each coin game machine 11, and collecting coins used in each coin game machine, runs inside the coin game island 10.

Figure 3:
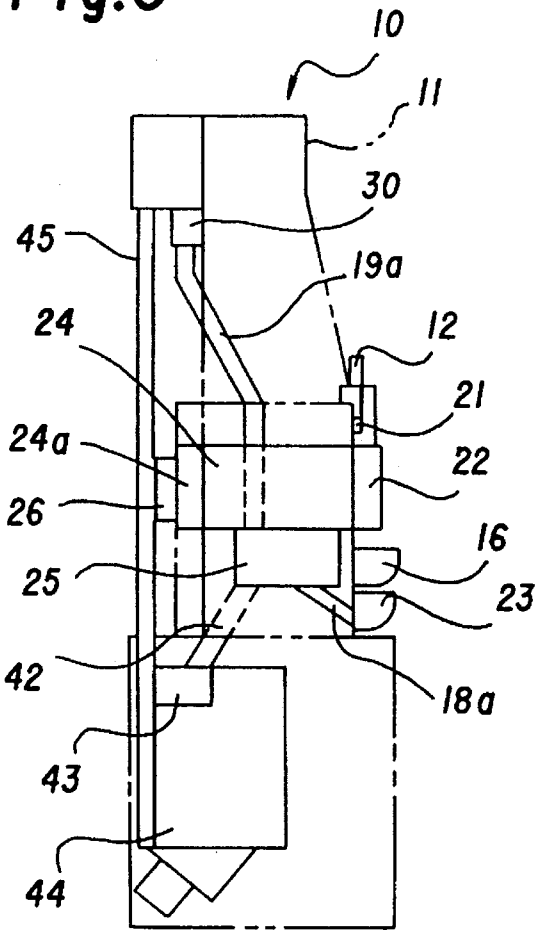
FIG. 3 is a side view showing the first embodiment of a coin game island.
Figure 2:
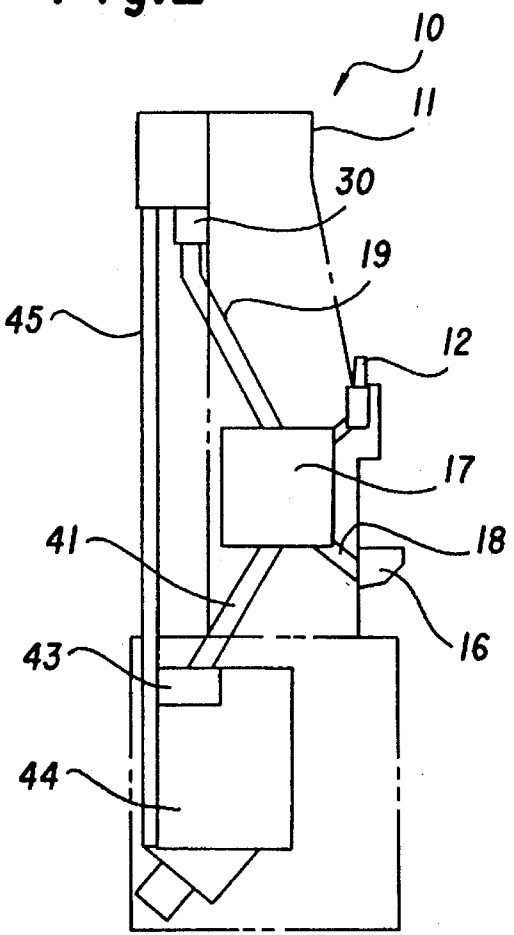
FIG. 2 is a side view showing the first embodiment of a coin game island.

As shown in FIGS. 1–3, the coin circulating path 1 includes a distribution conveyer 30 extending at each upper portion of the plural coin game machines 11 and coin dispensers 20; plural overflow passages 40–42 extending downwardly from the end of the distribution conveyer 30 and respective coin game machines 11; a collecting conveyer 43 extending at the lower portion of the island and connected to the ends of the respective overflow passages 40–42; a coin tank 44 placed at the outlet end side of the collecting conveyer 43 and a lift 45 for lifting coins stored in the coin tank 44 to the inlet end of the distribution conveyer 30.

The coin game machine 11 mounted on the coin game island 70 is a slot machine using a coin as a game medium. As shown in FIG. 1 and FIG. 2, a coin slot 12 and a liquid crystal display or LCD 13, displaying bars, bells, fruit, etc., are formed in the front of the coin game machine 11. The liquid crystal display or LCD 13 changes its displaying patterns when a player pulls an arm 14, and changing patterns are stopped respectively by pushing stop buttons 15 corresponding to the respective displaying portion of the liquid crystal display or LCD 13.

When combinations of stopped patterns of the liquid crystal display or LCD 13 lined with hit lines are the same as the given combinations, the coin game machine 11 dispenses coins from a game machine coin hopper 17 equipped with a counter an a coin return 16 according to the given dispensing rate by the order from a control section (not shown). The game machine coin hopper 17 is connected to the coin return 16 by a coin dispensing passage 18.

As shown in FIG. 1 and FIG. 3, coin dispensers 20 are mounted between coin game machines 11. The coin dispenser 20 is equipped with; a paper money slot 22; a paper money identifying section 24 for identifying counterfeit paper money from true paper money and the amount of inserted paper; and a money exchanging hopper 25 for counting and dispensing a given amount of coin to an exchanging coin tray 23 according to signals from the paper money identifying section. The money exchanging hopper 25 is connected to the exchanging coin tray 23 by a coin dispensing passage 18*a*.

A display 21 for displaying the balance (i.e., the amount of money left after taking away the amount of exchanged coins from inserted paper money) is mounted on the front of the coin dispenser 20. A paper money transferring apparatus 26 is mounted so that it extends to both end of the island along the terminus sides of the paper money identifying sections 24 of respective coin dispensers 20. In one side of the paper money transferring apparatus 26, a stock apparatus 27 which puts transferred paper money in order and piles the paper money therein, is positioned in one side of the paper money transferring apparatus.

The distribution conveyer 30, is one of the elements of the coin circulating path 1, supplies coins to the coin game machines 11, and the coin dispensers 20. The distribution conveyer 30 is located so as to extend almost horizontally at each upper portion of the respective coin game machines 11. As shown more in detail in FIG. 11–12, the distribution conveyer 30 includes a frame 31 located almost horizontally at an upper portion of the island and a belt 32 laid movably in the frame.

Plural distribution outlets 33 for each coin game machine 11 and each coin dispenser 20 are bored in the side 31*a* of the frame 31 of the distribution conveyer 30. Each distribution outlet 33 and the game machine coin hopper 17 of each coin game machine 11 are connected by coin introducing passage 19. Each distribution outlet 33 and the money exchanging hopper 25 of each coin dispenser 20 are similarly connected by coin introducing passage 19*a*.

A shutter 35 which can move between a closed position, for preventing coins on the distribution conveyer 30 from passing and for introducing coins into the distribution outlet 33, and an open position, for permitting passing of coins on distribution conveyer 30 downstream, is mounted above the distribution conveyer 30 beside said each distribution outlet 33.

The shutter 35 is supported, so as to be capable of opening and shutting by a driving member such as a rotary solenoid (not shown), on a cover 34 laid on upper edges of both side edges 31*a*, of the frame 31. The shutter 35 is set to be in an open position. However, when coins in each coin hopper 17, 25 are in short supply, the shutter is moved to a closed position by the driving member according to the signals from the sensors in the game machine coin hopper 17 and the money exchanging hopper 25.

As shown in FIG. 1, an end overflow passage 40 extending toward the lower portion of the island is connected to the end of the distribution conveyer 30. Respective game machine overflow passages 41 extending toward the lower portion of the island are connected to the game machine coin hoppers 17 of respective coin game machines 11, and respective money exchanging overflow passages 42 extending toward the lower portion of the island are connected to the money exchanging hoppers 25 of respective coin dispenser 20.

In the lower portion of the coin game island 10, the ends of the respective overflow passages 40–42 are connected to the collecting conveyer 43 extending almost horizontally. The collecting conveyer 43, similar to the distribution conveyer 30, includes a frame located almost horizontally at the upper portion of the island and a belt laid movably in the frame.

A coin tank 44, for storing collected coins temporarily, is placed at the outlet end side of the collecting conveyer 43, and a lift 45 for lifting coins stored in the coin tank 44 to the inlet end of the distribution conveyer 30 is mounted on the upper portion of the coin tank 44. Since both composition of the coin tank 44 and the lift 45 are well-known, they will not be explained.

Figure 4:
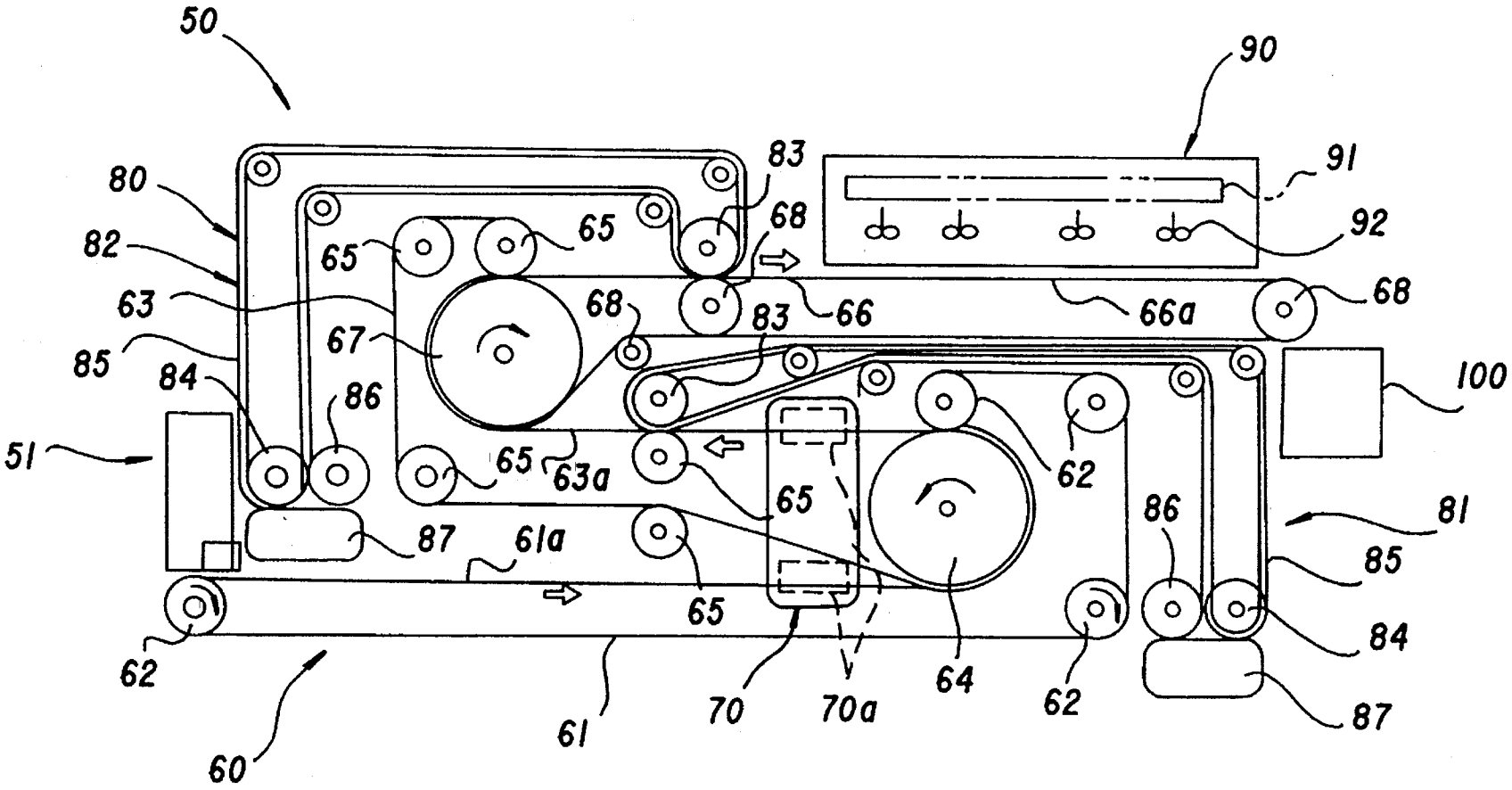
FIG. 4 is an elevational view showing the first embodiment of a coin treating apparatus.

As shown in FIG. 1, a coin treating apparatus 50 including a coin washing machine 70 is located at the outlet end side of the collecting conveyer 43, one component of the coin circulating path 1. As shown in FIG. 4, the coin treating apparatus 50 includes a coin supply machine 51 for receiving coins and sending them at a given interval; a conveying mechanism 60 for sending coins in the coin supply machine 51 to downstream for further processing; the coin washing machine 70 for removing dirt from the coins on the conveying mechanism 60; a dehydration mechanism 80 for absorbing water on washed coins; a dryer 90 for removing dampness from the dehydrated coins; and a coin packer 100 for packing washed and dried coins every given number of coins.

As shown in FIG. 1, the coin treating apparatus 50 is located at the outlet end side of the collecting conveyer 43 which is a part of the coin circulating path 1 supplying and collecting coins inside the coin game machine island 10. The coin game machine island 10 has plural coin game machines 11 which use a coin as a game medium and plural coin dispensers 20 for dispensing coins corresponding to an amount of money inserted, and coin game machines 11 and coin dispensers 20 are placed after ratingly side by side.

Figure 5:
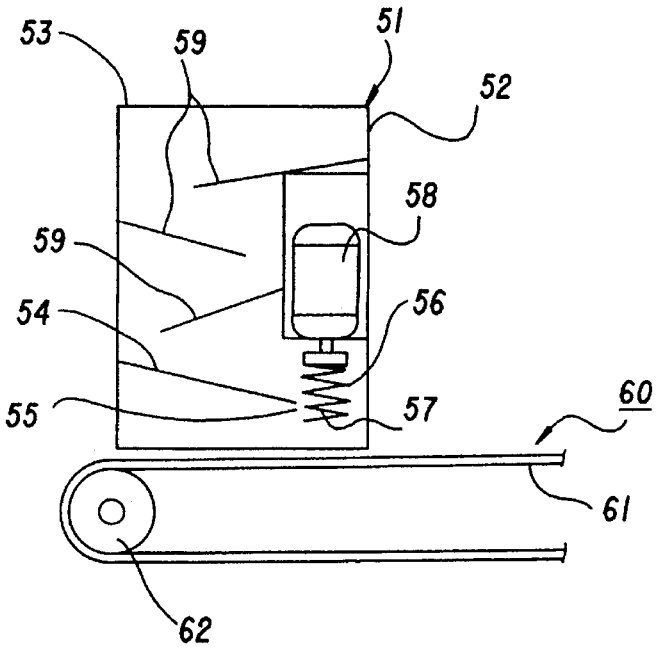
FIG. 5 is an elevational view showing a coin supply machine of the coin treating apparatus mounted inside the first embodiment of a coin game island.
Figure 6:
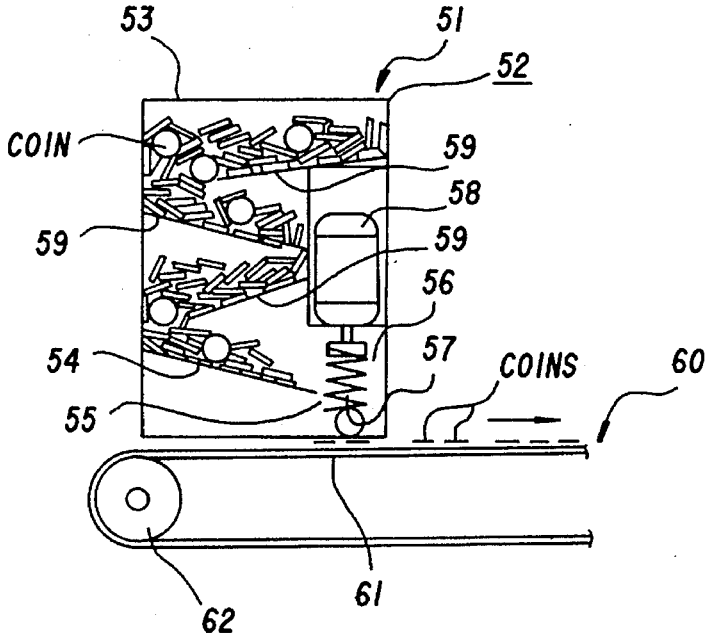
FIG. 6 is a schematic illustration showing a coin supply machine of the coin treating apparatus mounted inside the first embodiment of a coin game island.
Figure 7:
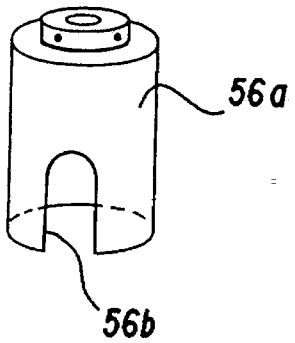
FIG. 7 is a perspective view showing a stirring member of a coin supply machine.

As shown in FIG. 5 and FIG. 6, a coin supply machine 51 of the coin treating apparatus 50 has a storage container 52 foe receiving coins on the collecting conveyer 43. The top end of the storage container 52 is opened as an opening portion 53 for receiving coins, and the bottom 54 of the storage container 52 is funnel-shaped. A coin outlet 55 is bored at the top of the funnel-shaped bottom 54 of the storage container 52.

A driving motor 58 is mounted on an inner wall of the storage container 52, a coiled spring (a stirring means) 56 is linked to the output shaft, which is directed downward, of the driving motor 58. The coiled spring 56 is placed so that its lower end may be slightly inserted into the coin outlet 55. When the coiled spring 56 is rotated an appropriate direction to pick up coins by the driving motor 58, coins enter gradually by degrees into the hollow portion 57 inside the coiled spring through outer gaps thereof and are sent out at a given interval.

The storage container 52 is alternately equipped with the multistage tilted boards 59, therein between its top end opening 53 and the coiled spring 56 at the lower portion of the storage container 52 for decreasing coin the weight of the coins on the coiled spring 56. Although the stirring member is the coiled spring 56 in this embodiment, a cylindrical member 56*a*, shown in FIG. 7, having a cutout portion 56*b* from where coins are dropped, may be used instead of the coiled spring 56.

As shown in FIG. 4, a conveying mechanism 60 includes a first conveying belt 61, which releases a coin washing machine 70, for conveying coins from the coin supply machine 51 without turning the coins over; a second conveying belt 63, which contact the first conveying belt 61, for conveying each turned over coin which has one washed surface, to said coin washing machine 70 to wash the other surface; and a third conveying belt 66 which contacts the second conveying belt 63.

The first conveying belt 61 is stretched by plural rollers 62, and it is on the stretched side 61a that is kept almost horizontal that the coins are placed thereon for sending them to the coin washing machine 70. A reversing roller 64 for stretching the second conveying belt 63 is in contact with the end of the stretched side 61*a* of the first conveying belt 61. The second conveying belt 63 is also stretched by plural rollers 65, and is mounted so as to turn over the coins conveyed by the first conveying belt 61 in order to pass the coins through the coin washing machine 70 again to wash the second surface.

A reversing roller 67 for stretching the third conveying belt 66 is in contact with the end of the stretched side 63*a* of the second conveying belt 63. The third conveying belt 66 is also stretched by plural rollers 68, and is mounted so as to turn over coins conveyed by the second conveying belt 63 and to pass the coins through a dryer 90.

Figure 8:
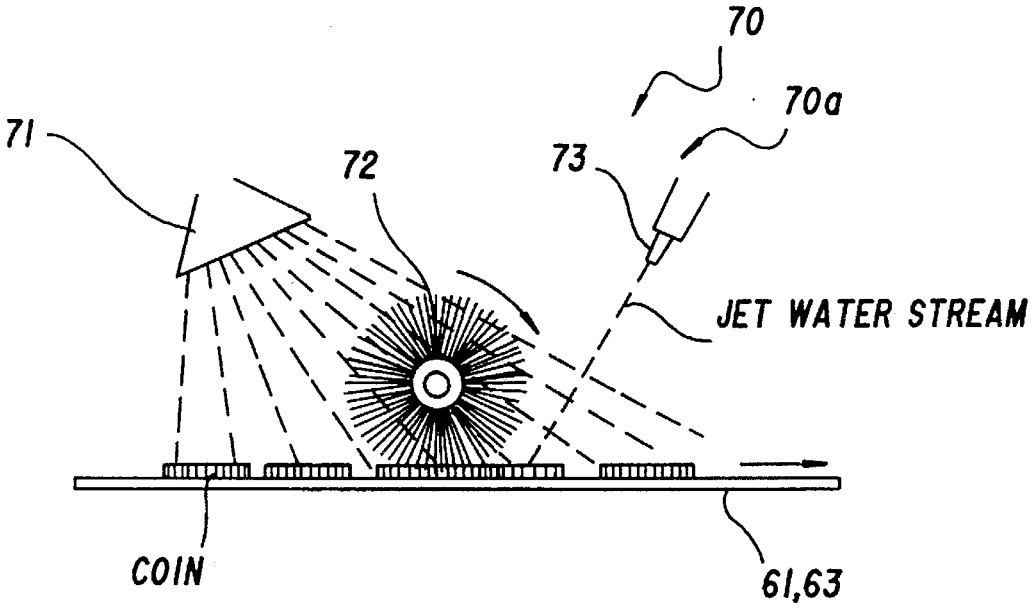
FIG. 8 is a schematic illustration showing a coin washing machine of the coin treating apparatus mounted inside the first embodiment of a coin game island.

As shown in FIG. 8, the coin washing machine 70 has a two washing units 70*a*, 70*a* for washing coins on the first conveying belt 61 and the second conveying belt 63 by water or hot water. Each washing machine 70 comprises a shower head 71, a rotating brush 72 and a jet nozzle 73.

The shower head 71 sprinkles water over the coins on said first conveying belt 61 and the second conveying belt 63. The rotating brush 72 is polishes wet coins by contacting to them with rotating. The jet nozzle 73 washes away dirt on the polished coins by shooting the jet water stream to the coins, and dirt sticking the ins and outs of coins is also taken off by the jet water at the same time.

As shown in FIG. 4, the dehydration mechanism 80 comprises the first dehydration section 81 for absorbing water on one surface of washed coins conveyed by said second conveying belt 63 and the second dehydration section 82 for absorbing water on the other surface of said washed coins conveyed by said third conveying belt 66. Said dehydration sections 81, 82 have a pair of quid rollers 83, 84 and an absorbing belt 85 set between the guide rollers 83, 84 respectively.

Figure 9:
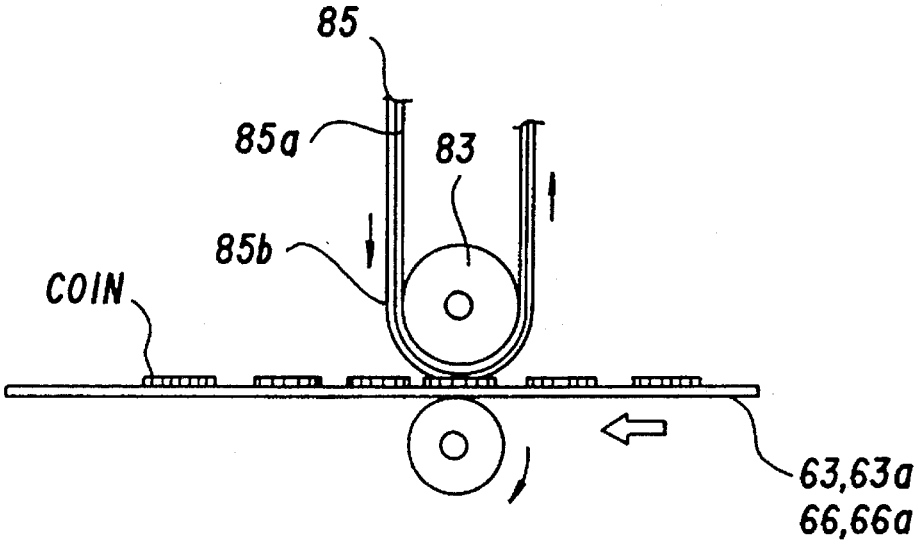
FIG. 9 is a partially enlarged view showing a dehydration mechanism of the coin treating apparatus mounted inside the first embodiment of a coin game island.
Figure 10:
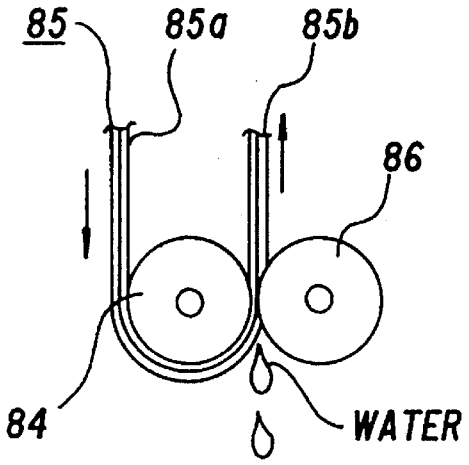
FIG. 10 is a partially enlarged view showing a part of a dehydration mechanism of the coin treating apparatus mounted inside the first embodiment of a coin game which is different from the part shown in FIG. 9.
Figure 11:
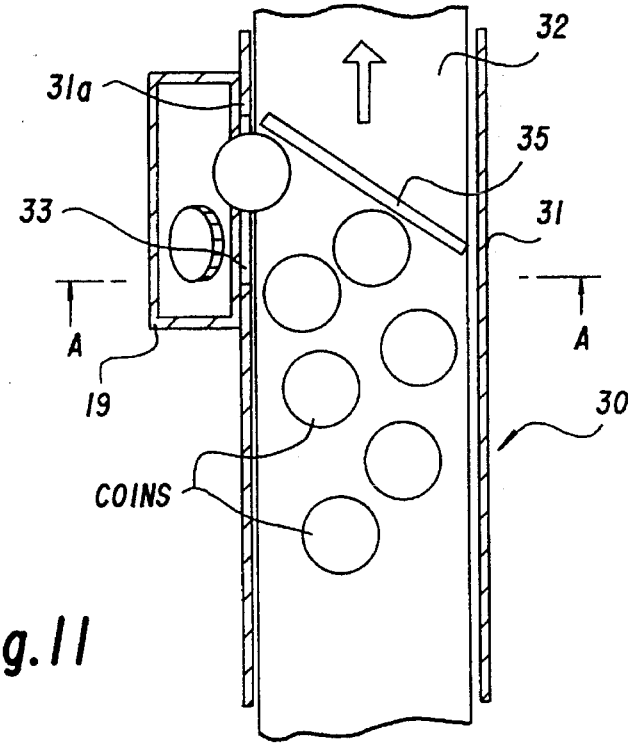
FIG. 11 is an plan view showing a distribution conveyer of the coin treating apparatus mounted inside the first embodiment of a coin game island.
Figure 12:
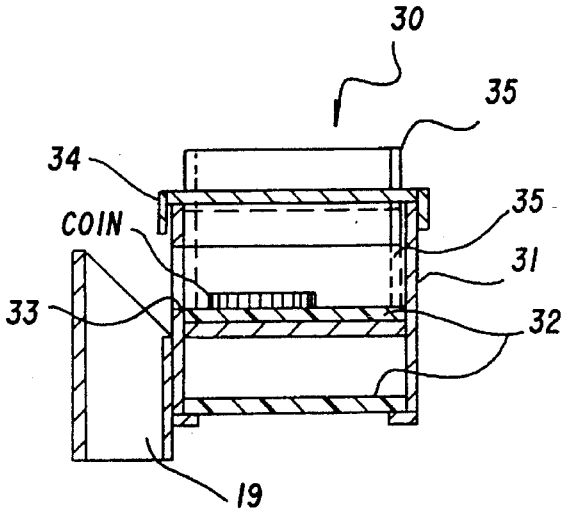
FIG. 12 is a sectional view taken substantially along the lines A—A of FIG. 11.

As shown in FIG. 9 and FIG. 10, one guide rollers 83 of said respective dehydration sections 81, 82, together with other rollers 65, 68, are positioned so as to press said absorbing belt 85 on the wet surfaces of coins on each conveying belt 61, 63 of said conveying mechanism 60; furthermore, a dehydration roller 86 is mounted by the other guide rollers 84 for squeezing water out of said absorbing belt 85 by putting the absorbing belt 85 between the dehydration roller 86 and the guide roller 84. And a water tank 87 for storing squeezing water out of said absorbing belt 85 is positioned under said dehydration roller 86.

To explain in more detail, an inner base surface portion 85*a* of the absorbing belt 85 is laminated so as to be in contact with the guide rollers 83. An outer absorbing surface portion 85*b* with wet surfaces of the coin. The base surface portion 85*a* is made of rubber or synthetic resins for giving strength to the absorbing belt 85, and the absorbing surface portion 85*b* is made of well water absorbing fibers for absorbing water on the coin surfaces.

As shown in FIG. 4, a dryer 90 is mounted above the third conveying belt 66 downstream from the second dehydration sections 82. The dryer 90 is for completely removing dampness from the on dehydrated coins. The dryer 90 is a hot air blowing dryer including a heater 91 and a blower 92.

Figure 13:
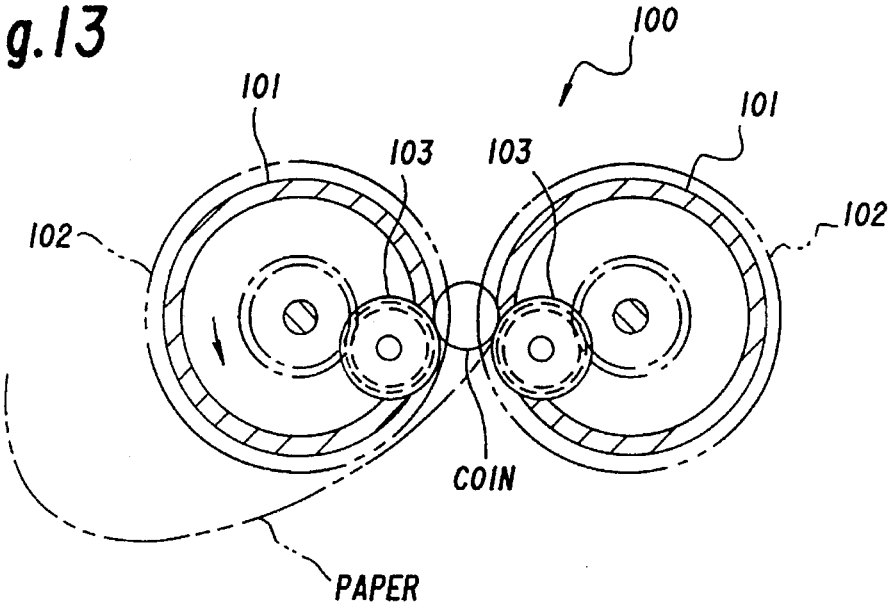
FIG. 13 is a partially enlarged view showing the first embodiment of a coin packer of the coin treating apparatus.
Figure 14:
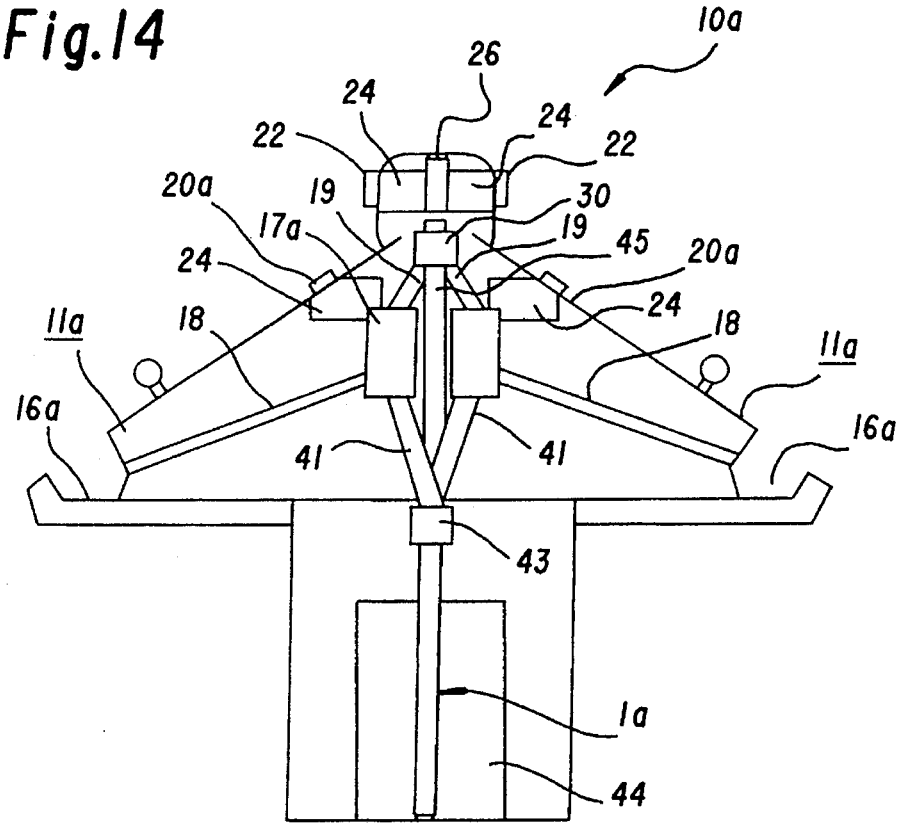
FIG. 14 is a side view the second embodiment of a coin game island.

As shown in FIG. 4, a coin packer 100 is mounted in the end side of the third conveying belt 66. The coin packer 100 is for packing washed and dried coins every given number of coins (for example 50 coins) by winding paper round piled coins. As shown in FIG. 13, the coin packer 100 includes a set of piling drums 101 capable of turning inversely towards each other; coin supporting guides 102, formed round outer walls of the piling drums 101, for supporting coins thereon and piling a given number coins (for example 50 coins); and a set of packing rollers 103, for packing piled coins by wrapping paper around them.

The operation of the first embodiment will be explained next.

As shown in FIG. 1–3, the plural coin game machines and coin dispensers 20 are placed alternatingly side by side each other in the coin game machine island 10 and are supplied coins, as game medium (including medals), through the distribution conveyer 30 extending at each upper portion of the can game machines and coin dispensers.

When a player inserts paper money into the paper money slot 22 of the coin dispenser 20, the paper money identifying section 24 identifies whether the inserted paper money is counterfeit paper money or not. When the paper money is judged to be counterfeit paper, the paper money is returned to the player through the paper money slot 22. When the inserted paper money is judged to be true paper money, coins of a given amount are dispensed into the exchanging coin tray 23 from the money exchanging hopper 25 according to signals from the paper money identifying section 24. At this time, the balance (i.e., the amount of money left after taking away the amount of exchanged coins from the amount of inserted paper money) is digitally displayed on the display 21. Paper money in the coin dispenser 20 is sent to the stock apparatus 27 at the end of the game island by the paper money transferring apparatus 26 and is put in order and piled therein.

The player can start a game by inserting coins from the exchanging coin tray 23 into the coin slot 12. When coins in the coin hopper 17 and/or money exchanging hopper 25 are in short supply, the shutter 35 located above the distribution conveyer 30 is moved from the open position to the closed position according to the signals from the sensors in the game machine coin hopper 17 and the money exchanging hopper 25.

Thus the shutter 35 prevents coins on the distribution conveyer 30 from passing and introduces coins into each distribution outlet 33, and then supplies coins to coin game machines 11 and/or coin dispensers 20 in short supply. Therefore coins can be efficiently supplied to each coin game machines 11 and/or coin dispensers 20 in the above-mentioned simple construction.

Coins sent to the end of the distribution conveyer 30 are sent to the collecting conveyer 43 extending at the lower portion of the island through an overflow passage 40. Coins used in each coin game machine 11 are sent to the collecting conveyer 43 through the game machine overflow passages 41, and similarly excessive coins in the coin dispensers 20 are sent to the collecting conveyer 43 through the money exchanging overflow passages 42.

Coins sent to the the collecting conveyer 43, after to be washed by the coin washing machine 70 of the coin treating apparatus 50, are stored in the coin tank 44 placed at the outlet end side of the collecting conveyer 43. Coins stored in the coin tank 44 are lifted again to the inlet end of the distribution conveyer 30 by the lift 45 and then circulate along with the coin circulating path 1 inside the island.

Since the coin washing machine 70 is provided in the coin circulating path 1, coin washing can be done within the coin game island. Therefore a the coin washing equipment mounted outside island and the conveying equipment such as a large scale conveyer for connecting the island and the coin washing equipment are unnecessary.

Coins are treated by the coin treating apparatus 50 mounted inside the end of the collecting conveyer 43 as follows. Coins on the collecting conveyer 43, as shown in FIG. 5, are sent into the storage container 52 of the coin supply machine 51 through its opening portion 53. Since the storage container 52 is equipped with the multistage tilted boards 59, therein, coins do not fall toward the bottom 54, but slip down the multistage tilted boards 59. Therefore, the coiled spring 56 at the lower portion of the storage container 52 does not add on more weight.

Although the coins which reach the funnel-shaped bottom 54 tend to collect at the coin outlet 55 bored at the top of the funnel-shaped bottom 54, coins do not flow out through the coin outlet 55 of the bottom 54 because the driving motor 58 is usually stopped. Thus, the coiled spring 56 prevents coins from glowing. Although some coins are dropped from outer gaps of the coiled spring 56, they have no effect.

When the coiled spring 56 is rotated to pick up coins by the driving motor 58, coins enter into the hollow portion 57 through outer gaps of the coiled spring 56 and move down to the coin outlet 55, and then they are sent to the conveying mechanism 60 at a given interval. The inverse rotation of the driving motor 58 causes sandwitching coins between the coin outlet 55 of the bottom 54 and the coiled spring 56.

Coins sent to the first conveying belt 61 of the conveying mechanism 60 at a given interval, as shown in FIG. 4, reach the coin washing machine 70 without being turned over. In the coin washing machine 70, as shown in FIG. 8, the shower head 71 sprinkles hot or cold water over one face of each coin to wet it. Thus, water can enter into all the nooks and cranies of the coins where granular abrasive cannot enter, thereby dissolving dirt on the coins in water.

Then, the rotating brush 72 polishes the wet coins. Finally, the jet nozzle 73 washes away dirt on a polished coins by shooting the jet water stream of water the coins. At this time, the jet stream of water also takes off dirt sticking the nooks and cranies of the coin.

Each coin washed having one surface is sandwiched between the first conveying belt 61 and the second conveying belt 63 within the section where the second conveying belt 63 contacts the reversing roller 64 and is raised by a height equal to the diameter of the reversing roller 64. Then, each coin is lain on the stretched side 63*a* of the second conveying belt 63 after being turned over and is sent to the coin washing machine 70 again. The other surface of each turned over coin is washed by the coin washing machine 70.

Almost all remaining water on both surfaces of the coin having both surfaces washed by the coin washing machine 70 is absorbed by the absorbing belt 85 of the first dehydration section 81 of the dehydration machanism 80 during the time the coins lay on the second conveying belt 63. That is, as shown in FIG. 9, coin on the the stretched side 63*a* of the second conveying belt 63 is sandwiched between the conveying belt and the absorbing belt 85 so that excess water is absorbed by the absorbing surface portion 85*b* of the absorbing belt 85.

The absorbing belt 85 which absorbs the water, as shown in FIG. 4, is sandwiched tightly between the guide roller 84 positioned in the other end side and the dehydration roller 86 positioned by the side of the guide roller 84. Water squeezed out of the absorbing belt 85 is recovered and stored in the water tank 87. Furthermore, each coin is sandwiched between the third conveying belt 66 and the second conveying belt 63 within the section where the third conveying belt 66 contacts the reversing roller 67 and is raised by a height equal to the diameter of the reversing roller 67. Then each coin is lain on the stretched side 66*a* of the third conveying belt 66 after being turned over.

Almost all remaining water on both surfaces of the turned over coin is absorbed by the absorbing belt 85 of the second dehydration section 82 of the dehydration machanism 80 during the time the coins lay on the third conveying belt 66. All remaining water on the coins surfaces which has not been absorbed by the dehydration mechanism 80 is blown by hot wind from the dryer 90 so that dampness on the dehydrated coins is removed.

Thus, the water remaining on washed coin is treated by the dehydration mechanism 80 and the dryer 90, and is completely removed. Therefore, solution, such as dirt in water, which causes spots or lack of gloss, is not left on the coin surfaces.

Coins dryed after washing are returned to the end of the collecting conveyer 43 or are circulated in the island, as needed, after being packed every given number of coins (for example 50 coins) by, the coin packer 100. When the coin packer 100 receives the coins, the set of piling drums 101, turn inversely towards each other to pile coins on the coiled coin supporting guides 102. Then the piled given number of coins are packed by wrapping paper by the set of packing rollers 103.

The second embodiment of the present invention is shown in FIG. 74. The components with that are the same as the components of the first embodiment are numbered the same numerals, and the explanations of those components will be omitted.

In the second embodiment, the coin dispenser 20*a*, mounted on the coin game island 70*a* is not equipped with a money exchanging hopper 25, but is equipped with only the paper money identifying section 24. The game machine coin hopper 17*a* mounted on the coin game machine 11*a* operates according to the signals, identifying the amount of money, fed to a control section (not shown). Then, a given number of coins are dispensed to the coin return 16*a*.

Thus, the coin introducing passage 19*a* for the coin dispenser 20*a*, the coin dispensing passage 78*a*, the money exchanging overflow passages 42, etc. are not neccesary, thus, the coin circulating path 1*a* can be simplified.

According to the coin game machine island and the coin treating apparatus of the present invention, the coin circulating path includes the distribution conveyer extending at the upper portion of the coin game machine island; overflow passages extending downwardly from the end of the distribution conveyer and respective coin game machines; a collecting conveyer extending at the lower portion of the island and connected to the ends of the respective overflow passage; a coin tank placed at the outlet end side of the collecting conveyer a lift for lifting coins stored in the coin tank to the inlet end of a distribution conveyer; the coin washing machine is provided in the coin circulating path; so that the coins can be washed inside the island. Thus, a coin washing equipment outside coin game machine island and a conveying equipment such as a large scale conveyer for connecting the island and the coin washing equipment are unnecessary. Furthermore, the coin treating apparatus does not need as large of a space as is needed by prior art devices and costs less to install and maintain.

Furthermore, the coin supply machine sends coins at a given interval. The conveying mechanism sends coins, in the coin supply mechanism, downstream for further processing. The coin washing machine removes dirt from coins on the conveying mechanism. Finally the dryer removes dampness from dehydrated coins so that all of the rooks and cranies of the coins can be washed sufficiently by water without using abrasives and water on the coins surfaces is eliminated efficiently and certainly.

We claim:

1. In a coin game machine island having a plurality of coin game machines which use a coin as a game medium and having a plurality of coin dispensers for dispensing coins corresponding to an amount of inserted money, a coin game machine of said plurality of coin game machines is placed alternatingly beside a coin dispenser of said plurality of coin dispensers, said coin game machine island comprising:

a coin circulating path having a distribution conveyer extending at each upper portion of said plural coin game machines and coin dispensers, plural overflow passages extending downwardly from the end of said distribution conveyer and respective coin game machines, a collecting conveyer extending at the lower portion of said island and connected to the ends of said respective overflow passages, a coin tank placed at the outlet end side of said collecting conveyer and a lift means for lifting coins stored in said coin tank to the inlet end of said distribution conveyer;

a coin washing machine provided in said coin circulating path;

a coin supply means for receiving coins on said coin circulating path and sending said coins, once received, to said coin washing machine at a given interval;

a conveying means for sending said coins in said coin supply machine downstream for further processing;

a dehydration means for absorbing water on said coins, once polished and washed; and a dryer means for removing dampness from said coins; and wherein said coin game machines, said coin dispensers, said coin circulating path, said distribution conveyer, said plural overflow passages, said collecting conveyer, said coin tank, said lift means, said coin washing machine, said coin supply means, said conveying means, said dehydration means and said dryer means are all mounted inside said coin game island.

2. The coin game machine island as in claim 1, wherein said coin washing machine comprises a shower head means for sprinking water over said coins, a rotating brush means for polishing said coins, when wet, by contacting said coins with said rotating brush, and a jet nozzle means for washing away any remaining dirt on said coins, once polished, by shooting jet water streams at said coins.

3. A coin game machine island as in claim 1, further comprising:

a coin supply machine for receiving coins on said coin circulating path and sending them to said coin washing machine at a given interval;

a conveying mechanism for sending coins in said coin supply machine to down stream for next processes;

a dehydration mechanism for absorbing water on washed coins; and a dryer for removing damp on dehydrated coins.

4. A coin game machine island as in claim 2, further comprising:

a coin supply machine for receiving coins on said coin circulating path and sending them to said coin washing machine at a given interval;

a conveying mechanism for sending coins in said coin supply machine to down stream for next processes;

a dehydration mechanism for absorbing water on washed coins; and a dryer for removing damp on dehydrated coins.

5. The coin game machine island as in either of claims 1 or 2, wherein a plurality of distribution outlet means for each coin game machine of said plurality of coin game machines are bored in the side of said distribution conveyer; further comprises coin introducing passages for connecting respective distribution outlets and respective coin game machines, and plural shutters, mounted above said distribution conveyer beside said each distribution outlet, capable of moving between shutting positions, for preventing coins on said distribution conveyer from passing and for introducing coins into said distribution outlets, and an opening positions, for permitting downstream passage of coins on said distribution conveyer.

6. A coin treating apparatus for mounting inside a coin game machine island in which plural coin game machines using a coin as a game medium are placed comprising:

a coin supply machine for receiving coins and sending them at a given interval;

a conveying mechanism for sending coins in said coin supply machine to down stream for next processes;

a coin washing machine for removing dirt on coins on said conveying mechanism; and a dehydration mechanism for absorbing water on washed coins, said conveying mechanism has a first conveying belt, reached said coin washing machine, for conveying coins from said coin supply machine without turning them over, a means for turning over said coins, and a second conveying belt, in contact with said first conveying belt, for conveying each turned over coin whose one surface has been washed to said coin washing machine again for washing the other surface, and said dehydration mechanism has a pair of guide rollers, an absorbing belt set between said guide rollers, a dehydration roller mounted by one of the guide rollers for squeezing water out of said absorbing belt by putting the absorbing belt between the dehydration roller and the guide roller, a water tank, for storing squeezing water out of said absorbing belt, positioned under said dehydration roller, and the other of said guide rollers is positioned so as to press said absorbing belt on the wet surfaces of coins on each conveying belt of said conveying mechanism.

7. The coin treating apparatus as in claim 6, in which said coin supply machine has a storage container for receiving coins comprising:

a funnel-shaped bottom;

a coin outlet bored at the top of the funnel-shaped bottom;

a stirring means, positioned at the lower portion in said storage container, having a rotating hollow portion for dropping coins to the outside of said coin outlet with taking in coins serially; and multistage tilted boards, for lightening weight of coins weighting on said stirring means, mounted on inner wall between top opening portion of said storage container and said stirring means at the lower of the storage container.

8. The coin treating apparatus as in claim 6, in which said coin washing machine comprises a shower head for sprinkling water over the coins on said each conveying belts, a rotating brush for polishing wet coins by contacting to them with rotating, and a jet nozzle for washing away dirt on the polished coins by shooting jet water stream to the coins.

9. The coin treating apparatus as in claim 7, in which said coin washing machine comprises a shower head for sprinkling water over the coins on said each conveying belts, a rotating brush for polishing wet coins by contacting to them with rotating, and a jet nozzle for washing away dirt on the polished coins by shooting jet water stream to the coins.

10. A coin treating apparatus as in clam 6, in which said coin washing machine comprises a shower head for sprinkling water over the coins on said each conveying belts, a rotating brush for polishing wet coins by contacting to them with rotating, and a jet nozzle for washing away dirt on the polished coins by shooting jet water stream to the coins.

11. The coin treating apparatus as in claim 6, 7, 8, or 9, further comprising a dryer having a heater and a blower.

12. The coin treating apparatus as in claim 6, 7, 8, or 9, further comprising a coin packer for packing the washed and dried coins every given number coins.

13. The coin treating apparatus as in claim 11, further comprising a coin packer for packing the washed and dried coins every given number coins.

14. A coin treating apparatus as in claim 10 further comprising a coin packer for packing the washed and dried coins every given number coins.

* * * * *